US009285772B2

(12) United States Patent
Millet et al.

(10) Patent No.: US 9,285,772 B2
(45) Date of Patent: Mar. 15, 2016

(54) BARREL FOR TIMEPIECE

(71) Applicant: ROLEX SA, Geneva (CH)

(72) Inventors: Florent Millet, Septmoncel (FR); Julien Saglini, Bienne (CH)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 14/753,277

(22) Filed: Jun. 29, 2015

(65) Prior Publication Data

US 2015/0378308 A1 Dec. 31, 2015

(30) Foreign Application Priority Data

Jun. 30, 2014 (EP) ..... 14174955

(51) Int. Cl.
*G04B 1/16* (2006.01)
*G04B 1/10* (2006.01)

(52) U.S. Cl.
CPC .... *G04B 1/16* (2013.01); *G04B 1/10* (2013.01)

(58) Field of Classification Search
CPC ..... G04B 1/165; G04B 1/16; G04B 1/18; G04B 1/12; G04B 1/10
See application file for complete search history.

(56) References Cited

U.S. PATENT DOCUMENTS 3,846,974 A * 11/1974 Giger ..... G04B 1/18 368/144
6,863,435 B2 * 3/2005 Moteki ..... F16F 1/10 267/272
7,942,573 B2 * 5/2011 Kury ..... G04B 31/0123 368/142
8,379,493 B2 * 2/2013 Mertenat ..... G04B 1/12 368/140
9,033,573 B2 * 5/2015 Kaelin ..... G04B 1/145 148/557
2010/0246339 A1 9/2010 Mertenat
2014/0211596 A1 7/2014 Kaelin et al.
2014/0376338 A1 12/2014 Kaelin et al.

FOREIGN PATENT DOCUMENTS

EP 2 060 957 A1 5/2009
EP 2 570 862 A1 3/2013
EP 2570861 A1 3/2013
EP 2 746 868 A1 6/2014
GB 1044852 A 10/1966

OTHER PUBLICATIONS

European Search Report dated Mar. 19, 2015, issued in corresponding European application No. EP 14 17 4955; with partial English translation and partial English machine translation (10 pages).

* cited by examiner

*Primary Examiner* — Sean Kayes
(74) *Attorney, Agent, or Firm* — Westerman, Hattori, Daniels & Adrian, LLP

(57) ABSTRACT

A barrel for timepiece movement, comprising a barrel shaft (20) around which is arranged, in a rotationally mobile manner, an assembly comprising a drum (30) and a cover (40) delimiting a housing (50) for receiving a barrel spring (51), the drum (30) and the cover (40) each having a wall (31, 41) extending from a peripheral end (34, 44) of the barrel to a central end of the barrel at the level of the barrel shaft (20), wherein at least a part of at least one of said walls (31, 41) has a variable thickness which increases continually with distance away from the peripheral end of the barrel.

20 Claims, 2 Drawing Sheets

BARREL FOR TIMEPIECE

The invention relates to a barrel for timepiece movement, a timepiece movement and a timepiece incorporating such a barrel, notably a wristwatch. It relates also to a method for manufacturing a barrel for timepiece movement.

STATE OF THE ART

FIG. 1 illustrates a barrel according to the traditional prior art architecture. It comprises a barrel shaft 1 around which is arranged, in a rotationally mobile manner, an assembly comprising a drum 2 and a cover 3 delimiting a housing 4 in which is arranged the barrel spring 15, partially represented. This spring transmits the energy necessary to operate a timepiece movement and therefore determines its power reserve. At its two ends, the shaft comprises end portions 15 and bearing surfaces 6, which cooperate with the components of the two movement blanks 10 of the timepiece movement, such as, for example, a bridge and a plate, between which the barrel shaft is mounted. These end portions 5 and these bearing surfaces 6 define the radial and axial guidance of the barrel in its movement, and minimize its radial and axial shake or clearance.

The drum 2 and the cover 3 form flat disks arranged around the barrel shaft 1, extending at right angles to this shaft. In their central part, they comprise annular protuberances 7 which form a first surface of contact 8 on the bearing surfaces of the barrel shaft 1, at right angles to the axis A of the barrel shaft. These annular protuberances also form a second surface of contact 9 with the barrel shaft, parallel to the axis of this shaft, arranged on the substantially cylindrical circumference of the barrel shaft 1. This approach makes it possible to ensure a reliable rotation and a clearance reduced to the minimum for the drum/cover assembly.

To obtain the greatest possible power reserve, it is necessary to use the highest possible spring 15 and therefore notably to maximize the height h of the housing 4, delimited by the respective inner surfaces of the drum 2 and of the cover 3. The later components, because of their form described above, are generally manufactured by material removal, notably by bar turning, which imposes minimum thicknesses e of their respective walls of the order of 0.2 mm, to guarantee flatnesses compatible with the correct operation of the barrel.

Thus, such a prior art solution makes it possible to obtain an efficient barrel. However, it does not make it possible to increase the volume of the housing provided for the barrel spring within the timepiece movement and therefore does not make it possible to increase the power reserve of the timepiece movement.

The document EP2570861 describes a barrel according to an alternative architecture, in which the clearance of the barrel in a direction parallel to the axis of the barrel shaft is obtained at least partially by a direct cooperation of the drum and of the cover with a bridge and a plate of the timepiece movement. Such an approach makes it possible to increase the height of the barrel spring compared to the traditional architecture described previously. However, this approach gives rise to a significant axial play of the barrel and increases the risk of wear. It is not therefore acceptable.

Thus, the object of the invention is to maximize the power reserve of a timepiece movement while offering an efficient and reliable barrel.

BRIEF DESCRIPTION OF THE INVENTION

To this end, the invention relies on a barrel for timepiece movement, comprising a barrel shaft around which is arranged, in a rotationally mobile manner, an assembly comprising a drum and a cover delimiting a housing for receiving a barrel spring, the drum and the cover each having a wall extending from a peripheral end of the barrel to a central end of the barrel at the level of the barrel shaft, wherein at least a part of at least one of said walls has a variable thickness which increases continually with distance away from the peripheral end of the barrel.

The invention is precisely defined by the claims.

BRIEF DESCRIPTION OF THE FIGURES

These objects, features and advantages of the present invention will be explained in detail in the following description of a particular embodiment given in a nonlimiting manner in relation to the attached figures in which:

FIG. 2 illustrates a barrel according to an embodiment of the invention. It comprises a barrel shaft 20 around which is arranged, in a rotationally mobile manner, a revolving assembly comprising a drum 30 and a cover 40 delimiting a housing 50 in which the barrel spring 51 is arranged. The barrel shaft 20 has an axis A of revolution and is intended to be mounted between two movement blanks of a timepiece movement, which are not represented. Each movement blank is, for example, a bridge or a plate. As in the traditional prior art solution, this barrel shaft guides the rotational movement of the revolving assembly and limits the axial and radial clearance of the barrel relative to the timepiece movement, by its links at its two ends which are designed to cooperate with the movement blanks. The axis A is therefore also the axis of rotation of the barrel.

Figure 1:
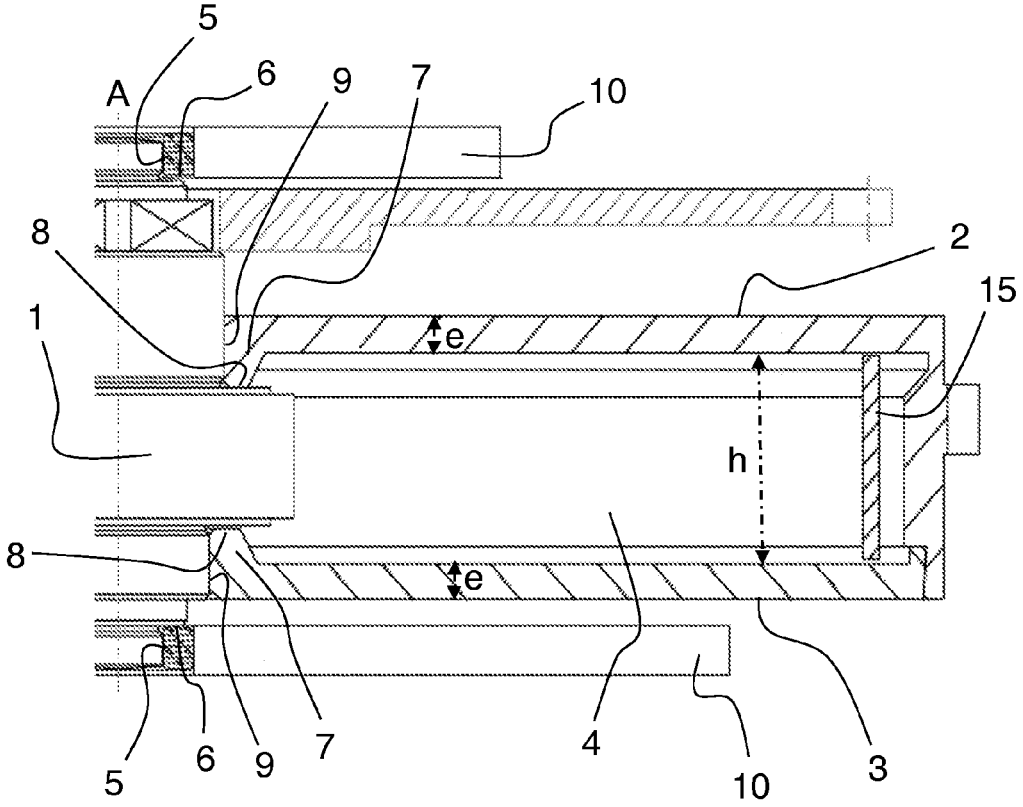
Fig. 1 PRIOR ART
FIG. 1 represents a cross-sectional view of a part of barrel according to a traditional prior art construction.

The drum 30 and the cover 40 comprise a first end which will be called peripheral end 34, 44 and a second end at the level of the barrel shaft 20 which forms their axis of rotation, which will be called central end. At, or roughly at, their peripheral end, they can form an elbow or bend to meet and close the housing 50. Between these two ends, the walls 31, 41 of the drum 30 and of the cover 40 preferentially have similar forms, symmetrical relative to a median plane at right angles to the axis of the barrel shaft.

The wall 31 of the drum 30, which extends between the barrel shaft 20 and its peripheral end 34, comprises an inner surface 32, oriented toward the interior of the housing 50, and an opposite outer surface 33. The inner surface 32 is substantially at right angles to the axis of the barrel shaft, forms a flat disk in a plane substantially at right angles to the axis of the barrel shaft, which makes it possible to delimit a housing 50 of substantially rectangular section, and which forms a cylinder portion around the barrel shaft. The outer surface 33 is slightly inclined relative to the direction at right angles to the axis of the barrel shaft, such that the thickness of the wall 31 of the drum, measured between the inner surface 32 and the outer surface 33, decreases continually in the direction from the center to the periphery.

At its central end, the wall 31 of the drum 30 thickens to form a protuberance 35 in the form of a cylinder portion. The central surface 36 of this protuberance, substantially parallel to the axis of the barrel shaft 20, comes into contact against this shaft, over the entire perimeter of the shaft, and thus guides the rotation around the shaft by minimizing the radial clearance. The inner surface 37 of the protuberance 35, substantially at right angles to the axis of the barrel shaft 20, comes to bear on a corresponding surface formed by a central portion of greater diameter 21 of the barrel shaft. Thus, this surface minimizes the axial clearance of the revolving assembly. Finally, this protuberance 35, arranged in the central end of the drum 30, allows for the axial and radial guidance with lesser play of the revolving assembly. For this, the protuberance has a height hs, measured between its inner surface 37 and the outer surface 38 of the drum 30 at the protuberance 35. This height hs is at least two times greater than the greatest thickness of the wall of the drum, excluding the protuberance 35, even at least three times greater than its minimum thickness.

On the other hand, this particular solution therefore comprises a drum 30 and a cover 40 which do not participate in keeping the barrel axial with respect to the movement blanks of the timepiece movement between which the barrel is mounted. Thus, the drum and the cover have no contact or guiding surface in contact with the movement blanks, notably a plate or a bridge. The barrel shaft fulfills this function on its own.

Figure 2:
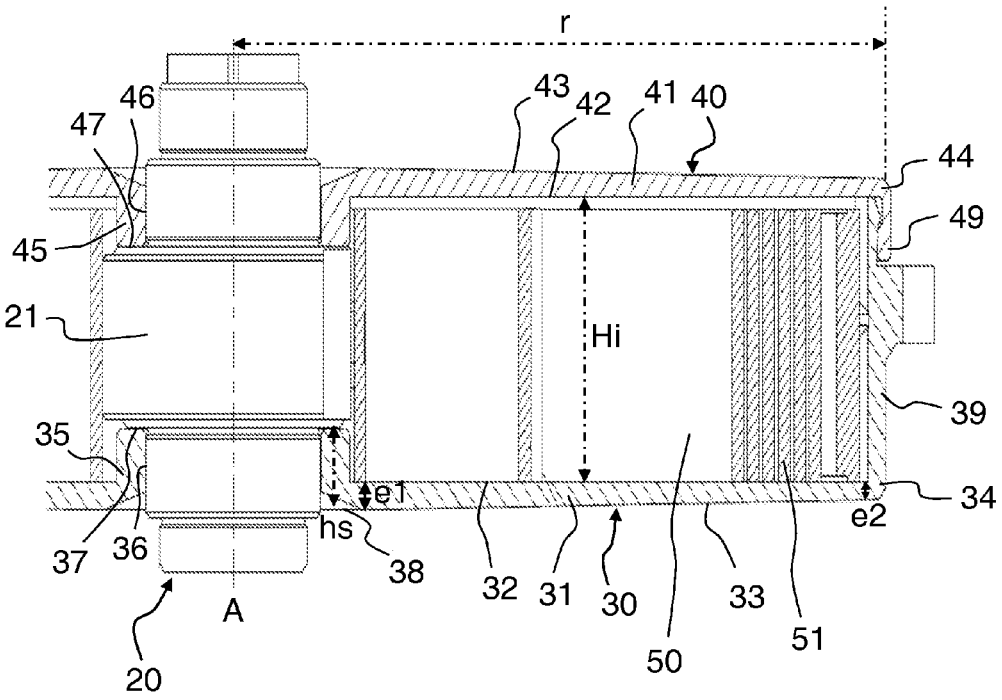
FIG. 2 represents a cross-sectional view of a part of barrel according to an embodiment of the invention.

Beyond this protuberance 35, the wall 31 has a greatly reduced thickness, minimized to offer the largest possible housing 50 arranged in the non-extendable restricted volume imposed by the timepiece movement, notably its two movement blanks between which the barrel is mounted, in order to naturally use the largest possible barrel spring, inducing the greatest possible power reserve. The wall 31 has a minimum thickness e2 at its peripheral end 34. Then, the outer surface 33 of this wall is inclined and extends away continually from the inner surface 32, as far as its boundary with the protuberance 35 of the drum 30, to continually increase the thickness of the wall 31 to a maximum thickness e1 at its central end at the boundary with the protuberance 35. Preferentially, the profile of the outer surface 33 is linear according to an axial cross-sectional view of the barrel such as that illustrated in FIG. 2.

This part of wall of the drum 30, which has a thickness which varies continually, makes it possible to use a wall that is less thick than the usual wall of a barrel according to the traditional prior art, while being sufficiently rigid to ensure a good assembly of the cover and of the drum, and allowing its accurate and repeatable production by a material removal method of bar turning type. Thus, the drum and/or the cover is/are advantageously made of a material suited to production by material removal, such as a copper-based alloy such as brass.

The result of this is that, for a given volume imposed on a barrel by the dimensions of a timepiece movement, the internal height Hi of the housing 50 of the barrel spring 51 is increased compared to the prior art, since the thickness of the wall 31 is reduced. In practice, tests and calculations show that the solution allows for a gain of the order of 10% in terms of autonomy of operation of a timepiece movement compared to a conventional barrel of the same diameter.

According to an exemplary embodiment, the inclination of the outer surface 33 of the wall 31 of the drum 30 is of the order of 0.5 degree. More generally, this inclination can be between 0.5 and 5 degrees inclusive, even between 0.5 and 2 degrees inclusive, more preferentially between 0.5 and 1.5 degrees inclusive.

It should be noted that the section of the wall 31 thus presents a truncated half-cone section whose axis of revolution is at right angles to the axis of rotation of the barrel and passes through the inner surface of the wall 31 of the drum.

This geometry of the wall of the drum is particularly suited to a watch, and any timepiece movement of a diameter less than or equal to 40 mm, even less than or equal to 35 mm, even less than or equal to 30 mm, or inscribed in such a circle. It is therefore suited, for example, to a drum of diameter less than or equal to 20 mm. By way of example, one embodiment can be based on a drum whose diameter is of the order of 12 mm, of which the minimum thickness e2 of the wall is 0.1 mm and the maximum thickness e2 excluding the protuberance is 0.15 mm. The protuberance can have a height hs of 0.45 mm. As a variant, this minimum thickness e2 could be less than or equal to 0.1 mm, for example be 0.09 or 0.08 mm. Such a geometry makes it possible to define a housing 50 of height Hi greater than or equal to 1.6 mm. More generally, the maximum thickness e1 of the part of wall of variable thickness is less than or equal to 0.18 mm, even 0.15 mm, and the minimum thickness e2 of the part of wall of variable thickness is less than or equal to 0.13 mm, even 0.1 mm.

Naturally, the wall 31 of the drum can have other geometries without departing from the concept of the invention. Firstly, the part with an inclined surface, of variable thickness, extends from the peripheral end of the drum and need not extend to the central end (to the immediate boundary with the protuberance). It may in effect extend over only a part of the radius r of the drum. It may then be completed by additional walls of constant thicknesses. Advantageously, it extends over at least half, even two-thirds, of the radius r of the drum. As a remark, it was found that a test with a very short inclined surface, for example a simple chamfer, optionally serves to stiffen the wall of the thicker portion, but has the following drawbacks: either the thickest area occupies a significant length, especially a significant radius, of the total wall and the solution has a large size in view of the proximity of the wall of the barrel with at least one blank of the movement, which does not allow to increase the volume of the barrel housing, or it occupies a short length, in particular a small radius, and the solution is not reliable because the wall becomes too weak, in particular for the assembly of the barrel, in particular to allow assembly of the cover on the drum. As a further remark, a simple chamfer forms a step and is similar in fact to a discontinuous solution, contrary to the invention. The solution of the invention can solve the technical problem with a continuous and of sufficient length inclined surface, as above described.

Furthermore, this part of wall of variable thickness can be obtained by a form other than a linearly inclined planar outer surface, this surface can for example be curved. In all cases, this part of surface is continuous. It advantageously has a minimum thickness e2 toward the peripheral end and a maximum thickness e1 toward the central end.

More generally, the drum wall advantageously has a part of variable thickness, decreasing from a maximum thickness e1 to a minimum thickness e2, with a ratio e1/e2 greater than or equal to 1.4. In addition, the wall advantageously has a protuberance of height hs at its central end, with a ratio hs/e2 between this height and the abovementioned minimum thickness greater than or equal to 3.

As mentioned previously, the cover 40 advantageously has a form identical and symmetrical to that of the drum 30. Thus, everything that has been detailed above with respect to the drum can be applied to the cover. Only the bends of the two components, at their peripheral ends, may differ: they advantageously form respective walls 39, 49, substantially parallel to the axis of the barrel shaft, which come to cooperate by any means, to close the housing 50.

Thus, the cover 40 also has a protuberance 45 at its central end, with two surfaces 46, 47 in contact with corresponding surfaces of the barrel shaft 20 to ensure that it is secured axially and radially, with a minimum of clearance, as for the drum. Furthermore, its wall 41, apart from the protuberance, also has an inclined outer surface 43, the profile of which is preferentially linear according to an axial cross section of the barrel, which makes it possible to continually reduce its thickness from the maximum thickness e1 at the boundary with the protuberance 45 to a minimum thickness e2 at the peripheral end 44 of this top surface. The inner surface 44 of the wall 41 remains planar and at right angles to the axis of the barrel shaft.

Naturally, other embodiments can be devised, in which just one of the two walls 31, 41 of, respectively, the drum 30 and the cover 40, has the geometry explained previously. According to another variant, these two walls implement geometries according to the concept of the invention, but with different and non-symmetrical geometries.

The invention claimed is:

1. A barrel for timepiece movement, comprising:

a barrel shaft, and an assembly comprising a drum and a cover delimiting a housing for receiving a barrel spring, the assembly being arranged around the barrel shaft in a rotationally mobile manner, the drum and the cover each having a respective wall extending from a peripheral end of the barrel to a central end of the barrel in a vicinity of the barrel shaft, wherein at least a part of at least one of said respective walls has a variable thickness which increases continually with distance away from the peripheral end of the barrel, over a distance of at least half a radius of the drum.

2. The barrel for timepiece movement as claimed in claim 1, wherein the part of wall of the drum or of the cover has an inner surface substantially at right angles to an axis of the barrel shaft and an outer surface inclined relative to the axis of the barrel shaft so as to extend away from the inner surface and increase the thickness of the wall on approaching the barrel shaft.

3. The barrel for timepiece movement as claimed in claim 1, wherein the part of wall of the drum or of the cover which has a variable thickness extends over at least one of (i) from a peripheral end of the wall to a central end of the wall, and (ii) a distance of at least two-thirds of the radius of the drum.

4. The barrel for timepiece movement as claimed in claim 1, wherein the part of wall of the drum or of the cover comprises an outer wall which has an inclination of angle greater than or equal to 0.5 degree relative to a plane at right angles to the axis of the barrel shaft.

5. The barrel for timepiece movement as claimed in claim 4, wherein the part of wall of the drum or of the cover comprises an outer wall which has an inclination of angle between 0.5 and 5 degrees inclusive.

6. The barrel for timepiece movement as claimed in claim 4, wherein the part of wall of the drum or of the cover comprises an outer wall which has an inclination of angle between 0.5 and 2 degrees inclusive.

7. The barrel for timepiece movement as claimed in claim 4, wherein the part of wall of the drum or of the cover comprises an outer wall which has an inclination of angle between 0.5 and 1.5 degrees inclusive.

8. The barrel for timepiece movement as claimed in claim 1, wherein at least one of (i) a ratio between a maximum thickness of the part of wall and a minimum thickness of the part of wall is greater than or equal to 1.4 (ii) the maximum thickness of the part of wall is less than or equal to 0.18 mm, and (iii) the minimum thickness is less than or equal to 0.13 mm.

9. The barrel for timepiece movement as claimed in claim 8, wherein at least one of (i) the drum and (ii) the cover comprises a protuberance at a central end thereof, having at least one surface of contact with the barrel shaft for rotational guidance thereof around the barrel shaft.

10. The barrel for timepiece movement as claimed in claim 9, wherein a ratio between a height of the protuberance and the minimum thickness of the part of wall is greater than or equal to 3.

11. The barrel for timepiece movement as claimed in claim 9, wherein at least one of (i) the drum and (ii) the cover is made of a copper-based alloy.

12. The barrel for timepiece movement as claimed in claim 8, wherein at least one of (i) the maximum thickness of the part of wall is less than or equal to 0.15 mm, and (ii) the minimum thickness is less than or equal to 0.10 mm.

13. The barrel for timepiece movement as claimed in claim 1, wherein a diameter of the drum is less than or equal to 20 mm.

14. The barrel for timepiece movement as claimed in claim 1, wherein at least one of (i) the drum and (ii) the cover does not comprise any radial or axial guiding surface configured to be in contact with the timepiece movement outside of the barrel.

15. The barrel for timepiece movement as claimed in claim 1, wherein at least one of (i) the drum and (ii) the cover is made of a material suitable for production by removal of material.

16. A timepiece movement comprising a barrel as claimed in claim 1.

17. The timepiece movement as claimed in claim 16, which has a diameter less than or equal to 40 mm.

18. A timepiece comprising a barrel as claimed in claim 1.

19. The timepiece as claimed in claim 18, which comprises two movement blanks between which the barrel shaft is mounted, wherein the barrel shaft comprises, at ends thereof, first radial and axial guiding surfaces for the barrel cooperating with the movement blanks, and wherein the barrel shaft comprises second axial and radial guiding surfaces for the rotation of the barrel drum and cover.

20. A method for manufacturing a barrel for timepiece movement, comprising:

producing by material removal at least one of (i) a barrel drum and (ii) a cover intended to delimit a housing to receive a barrel spring, the drum and the cover each having a respective wall extending from a peripheral end of the barrel to a central end of the barrel in a vicinity of the barrel shaft, wherein the producing step creates a variable thickness, which increases continually with distance away from the peripheral end of the barrel, of at least a part of at least one of said walls over a distance of at least half a radius of the drum.

* * * * *